US008574322B2

(12) United States Patent
Kelly

(10) Patent No.: US 8,574,322 B2
(45) Date of Patent: Nov. 5, 2013

(54) PROPELLANT COMPOSITIONS AND METHODS OF MAKING AND USING THE SAME

(75) Inventor: Kevin Kelly, Friendswood, TX (US)

(73) Assignee: Total Raffinage Marketing, Puteaux (FR)

( * ) Notice: Subject to any disclaimer, the term of this patent is extended or adjusted under 35 U.S.C. 154(b) by 324 days.

(21) Appl. No.: 12/949,980

(22) Filed: Nov. 19, 2010

(65) Prior Publication Data

US 2012/0157724 A1 Jun. 21, 2012

(51) Int. Cl.
*C10L 1/00* (2006.01)
*C06B 47/02* (2006.01)

(52) U.S. Cl.
USPC ..... 44/300; 149/120; 585/1; 585/14; 60/214

(58) Field of Classification Search
USPC ..... 149/36, 91, 120; 60/214; 585/1, 14
See application file for complete search history.

(56) References Cited

U.S. PATENT DOCUMENTS

| | | | | |
|---|---|---|---|---|
| 5,616,882 | A * | 4/1997 | Nichols et al. | 102/287 |
| 7,056,869 | B2 | 6/2006 | Guyomar | |
| 7,071,150 | B2 | 7/2006 | Genuyt | |
| 7,311,814 | B2 | 12/2007 | Guyomar | |
| 2005/0027148 | A1 | 2/2005 | Connor | |
| 2007/0251615 | A1 | 11/2007 | Amtower | |

FOREIGN PATENT DOCUMENTS

GB 834776 5/1960

OTHER PUBLICATIONS

"Extent and Impacts of Hydrocarbon Fuel Compositional Variability for Aerospace Propulsion Systems" pp. 1-15 Matt Bilingsley, Tim Edwards, Linda M Shafer, Thomas J Bruno published Jul. 12, 2010.*
"Preliminary Surrogate Mixture Models for the Thermophysical Properties of Rocket Propellants RP-1 and RP-2" M. L. Huber, E. W. Lemmon, L.S. Ott and T. J. Bruno, Energy and Fuels (2009), 23, 3083-3088 published May 19, 2009.*

* cited by examiner

*Primary Examiner* — Pamela H Weiss
(74) *Attorney, Agent, or Firm* — Harness, Dickey & Pierce, P.L.C.

(57) ABSTRACT

Formulated propellants and methods of forming the same are described herein. The formulated propellants include a hydrocarbon fluid, wherein the formulated propellant exhibits a distillation curve 10% point at a temperature between 365° F. (185° C.) and 410° F. (210° C.) and an end point at or below 525° F. (273° C.).

25 Claims, 10 Drawing Sheets

PROPELLANT COMPOSITIONS AND METHODS OF MAKING AND USING THE SAME

FIELD

Embodiments of the present invention generally relate to propellant formulations.

BACKGROUND

Currently, rocket propellant 1 (RP-1), in combination with liquid oxygen, is used as the propellant system in a large percentage of launch vehicles and rockets. However, supply is limited, resulting in little opportunity to optimize fuel formulations. Furthermore, limited supply results in little to no redundancy in supply in the event of supply shortages/failures.

Therefore, a need exists to develop alternative propellant formulations.

SUMMARY

Embodiments of the present invention include formulated propellants. The formulated propellants include a hydrocarbon fluid, wherein the formulated propellant exhibits a distillation curve 10% point at a temperature between 365° F. (185° C.) and 410° F. (210° C.) and an end point at or below 525° F. (273° C.).

In one or more embodiments, the propellant of the preceding paragraph is formulated for vehicles selected from launch vehicles, rockets, and hypersonic space planes.

In one or more embodiments, the propellant of any preceding paragraph meets RP-1 specifications.

In one or more embodiments, the propellant of any preceding paragraph includes less than 5% (by volume) aromatics.

In one or more embodiments, the propellant of any preceding paragraph includes less than 100 ppm aromatics.

In one or more embodiments, the propellant of any preceding paragraph includes less than 30 ppm sulfur.

In one or more embodiments, the propellant of any preceding paragraph includes less than 3 ppm sulfur.

In one or more embodiments, the propellant of any preceding paragraph includes at least two hydrocarbon fluids.

In one or more embodiments, the propellant of any preceding paragraph includes at least three hydrocarbon fluids.

In one or more embodiments, the propellant includes the propellant of any preceding paragraph, wherein the at least two hydrocarbon fluids include a first fluid exhibiting a density greater than 0.8 g/ml and a second fluid exhibiting a density less than 0.8 g/ml.

In one or more embodiments, the propellant of any preceding paragraph includes at least one hydrocarbon fluid derived from petroleum refining cuts selected from gas oil, kerosene, straight run diesel, ultralow sulfur diesel, coker diesel, light cycle oil, after deep desulfuration and dearomatization or hydrodewaxing cuts, gas to liquid cuts or biomass conversion cuts or polymerization of propene, butene or combinations thereof.

Embodiments of the invention generally include methods of formulating a formulated propellant including providing a hydrocarbon fluid and formulating the hydrocarbon fluid to form the formulated propellant, wherein the formulated propellant exhibits a distillation curve 10% point at a temperature between 365° F. (185° C.) and 410° F. (210° C.) and an end point at or below 525° F. (273° C.).

In one or more embodiments, the method includes the method of the preceding paragraph, wherein the formulated propellant meets RP-1 specifications.

One or more embodiments include a formulated propellant including a refined product from at least two separate starting materials, wherein the formulated propellant exhibits a distillation curve 10% point at a temperature between 365° F. (185° C.) and 410° F. (210° C.) and an end point at or below 525° F. (273° C.).

One or more embodiments include a method of forming a formulated propellant including blending two or more hydrocarbon fluids to form a formulated propellant meeting RP-1 specifications.

DETAILED DESCRIPTION

Introduction and Definitions

Figure 1:
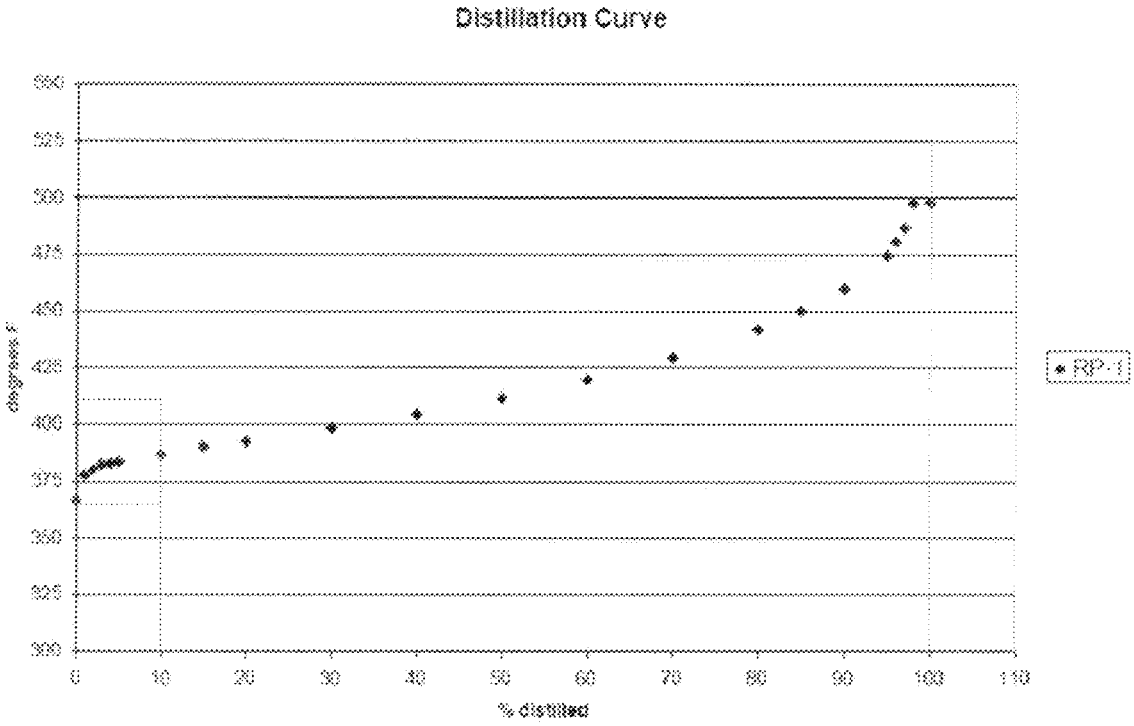
FIG. 1 illustrates an RP-1 distillation curve.

A detailed description will now be provided. Each of the appended claims defines a separate invention, which for infringement purposes is recognized as including equivalents to the various elements or limitations specified in the claims. Depending on the context, all references below to the "invention" may in some cases refer to certain specific embodiments only. In other cases it will be recognized that references to the "invention" will refer to subject matter recited in one or more, but not necessarily all, of the claims. Each of the inventions will now be described in greater detail below, including specific embodiments, versions and examples, but the inventions are not limited to these embodiments, versions or examples, which are included to enable a person having ordinary skill in the art to make and use the inventions when the information in this patent is combined with available information and technology.

Various terms as used herein are shown below. To the extent a term used in a claim is not defined below, it should be given the broadest definition skilled persons in the pertinent art have given that term as reflected in printed publications and issued patents at the time of filing. Further, unless otherwise specified, all compounds described herein may be substituted or unsubstituted and the listing of compounds includes derivatives thereof.

Further, various ranges and/or numerical limitations may be expressly stated below. It should be recognized that any ranges include iterative ranges of like magnitude falling within the expressly stated ranges or limitations.

Embodiments of the present invention relate to formulated propellants adapted for use in vehicles capable of utilizing RP-1 (alternately, Rocket Propellant-1 or Refined Petroleum-1) as propellant. A large percentage of those vehicles are launch vehicles and rockets, while additional vehicles include hypersonic space planes, such as those powered by ramjets or scramjets, for example. Ramjets are generally jet engines that utilize a jet's forward motion to compress incoming air, which generally cannot produce thrust at zero airspeed and thus cannot move a jet aircraft from a standstill. A scramjet is a variant of the ramjet in which the combustion process takes place in supersonic airflow.

Generally, RP-1 is formed of highly refined kerosene outwardly similar to jet fuel. Kerosene is generally obtained from the fractional distillation of petroleum between 140° C. and 250° C., resulting in a mixture of carbon chains that typically contain between 10 and 25 carbon atoms per molecule. For example, RP-1 may have a molecular weight of about 175, a density of about 0.82 g/ml and a boiling point range of from 350° F. (176° C.) to 525° F. (273° C.).

Rockets generate thrust by expelling mass behind them at high speed. Chemical rockets react propellant and oxidizer, such as liquid oxygen, in a combustion chamber creating a stream of high velocity gas to produce thrust. While on paper any petroleum crude oil can produce some RP-1 with enough processing, in practice, the fuel is sourced from a small number of oil fields with high-quality base stock.

The current payloads of these vehicles are limited by the density and energy content of the propellants. At present, many liquid propellants suitable for launch vehicles and rockets conform to RP-1 specifications, which are incorporated by reference herein. Some of the chemical and physical property specifications characterizing RP-1 are shown in Table 1 below.

TABLE 1

| Property | RP-1 Limit | RP-2 Limit | ASTM Method |
|---|---|---|---|
| Fuel Evaporated 10% (° F.) | 365-410 | 365-410 | |
| End Point (° F.) | 525 max | 525 max | D-86 |
| Specific Gravity (60° F.) | 0.799-0.815 | | D-1298 |
| Sulfur (ppm) | 30 max | 0.1 max | D-5623 |
| Mercaptan Sulfur (ppm) | 3 max | Not Required | D-3227 |
| Freezing Point (° F.) | −60 max (−51° C.) | −60 max (−51° C.) | D-2386 |
| Net Heat of Combustion (BTU/lb) | 18,500 min | 18,500 min | D-240 |
| Aromatics (vol %) | 5 max | 5 max | D-1319 |
| Olefins (vol %) | 2 max | 2 max | D-1319 |
| Hydrogen content (wt %) | 13.8 min | 13.8 min | D-3343 |
| Flash Point (° F.) | 140 min (60° C.) | 140 min (60° C.) | D-93 |

*as reported by the United States Defense Department Specification MIL-DTL-25576E, dated Apr. 14, 2006

Unlike current RP-1 propellants, the propellants of the present invention are formulated by appropriate methods, such as blending one or more hydrocarbon fluids to form formulated propellants meeting the RP-1 specifications, as identified above.

As used herein, the term "hydrocarbon fluids" is used in a generic sense to describe a wide range of materials used in an equally wide range of applications. The hydrocarbon fluids generally utilized for the formulated propellants described herein may be produced from a few common processes. For example, hydrocarbon fluids can be produced from severe hydrotreating, deep hydrotreatment or hydrocracking to remove sulfur and other heteroatoms or polymerization or oligomerization process, such processes being followed by hydrogenation under severe conditions to remove/reduce aromatics below 500 ppm aromatics and distillation to separate them into narrow boiling ranges. In some cases there may be additional steps, such as chemical or physical separation in order to concentrate a stream into isoparaffins or paraffins. Further, isoparaffins derived from oligomerization may constitute hydrocarbon fluids.

Hydrocarbon fluids are also described in U.S. Pat. No. 7,311,814 and U.S. Pat. No. 7,056,869, which are incorporated by reference herein. Unlike fuels, hydrocarbon fluids tend to have a narrow boiling point range, e.g., less than 500° F. (260° C.), or 300° F. (148° C.) or 100° F. (37° C.), for example. Such narrow cuts provide a precise flash point and provide for better defined viscosity, improved viscosity stability and defined evaporation conditions, as shown by the distillation curve, for example. The hydrocarbon fluids may be produced by hydrocracking a vacuum gas oil distillate, fractionating and/or hydrogenating the hydrocracked vacuum gas oil. Such fluids may have an ASTM D86 boiling point range of from 212° F. (100° C.) to 752° F. (400° C.), wherein the individual hydrocarbon fluids may have the narrow boiling ranges described herein. The fluids may further have a naphthenic content of at least 40 wt. %, or 60 wt. % or 70 wt. %, for example. The fluids may further have an aromatics content of less than 2 wt. %, or 1.5 wt. % or 1.0 wt. %, for example. The fluids may further have an aniline point below 212° F. (100° C.), or 205° F. (96° C.) or 200° F. (93° C.), for example. Such fluids may conventionally be useful as solvents, printing inks, drilling fluids, metal working fluids and silicone extenders, for example.

In one or more embodiments, the hydrocarbon fluids may be included in lubricating compositions for drilling fluids (such as described in U.S. Pat. No. 7,071,150, which is incorporated by reference herein). While all of these materials may have disparate uses including cosmetics applications, drilling fluids, fracture fluids, crop applications, plus others, the hydrocarbon fluids derive certain properties from their production that make them suitable for use in formulating rocket fuel. These properties include sulfur concentrations that are low enough to be below the RP-1 specification, e.g., less than 30 ppm, or less than 15 ppm or less than 3 ppm, aromatics contents that are below 1.0 vol. %, or 0.5 vol. % or 0.01 vol. %, for example, net heats of combustion above the RP-1 specification (as a result of the low aromatics content), and narrow distillation ranges that are either within or overlap the boiling range for RP-1, for example. Further, depending on how the hydrocarbon fluid is processed and produced, the hydrocarbon fluid may be further characterized as predominantly paraffinic, isoparaffinic, or naphthenic (e.g., greater than 40 wt. %, or 50 wt. % or 60 wt. % or 80%). While such characterization may be helpful in blending to achieve very low densities and/or high net heats of combustion, such characterization is not a necessary condition for formulation. Some illustrative, non-limiting chemical and physical property ranges characterizing various hydrocarbon fluids are shown in Table 2 below.

TABLE 2

| Property | Range | ASTM Method |
|---|---|---|
| End Point (° F.) | 250-600 or <525 (121-315° C. or <273° C.) | D-86 |
| Specific Gravity (60° F.) | 0.760-0.825 or 0.79-0.81 | D-1298 |
| Sulfur (ppm) | 0.1-5.0 or <3 | D-5623 |
| Mercaptan Sulfur (ppm) | <1 or <0.5 | D-3227 |
| Freezing Point (° F.) | −120 to −40 (−84 to −40° C.) | D-2386 |
| Net Heat of Combustion (BTU/lb) | >18,250, >18,600, >18,750 | D-240 |
| Aromatics (vol %) | 0-1.0 | D-1319 |
| Olefins (vol %) | 0-0.1 | D-1319 |
| Hydrogen content (wt %) | 13.0-15.3 | D-3343 |
| Flash Point (° F.) | 130-225, >140 (54-107° C., >60° C.) | D-93 |

The hydrocarbon fluids can be derived from any suitable starting material that can result in materials that meet the final use requirements. It is to be noted that starting materials need not fall into final product boiling range, as in the gas oil case stated above. Thus, starting materials for production of hydrocarbon fluids can be gas oils or other high molecular weight material (that are further hydrocracked to lower molecular weight materials or deep hydrotreated to decrease sulfur content, materials that are normally classified as distillates, such as kerosene, straight run diesel, ultralow sulfur diesel, coker diesel (with sufficient hydroprocessing), or light cycle oil from FCC units, for example. Starting materials can be kerosene or gas oils from Gas to Liquid process or from biomass conversion processes. Additionally, the starting materials may be olefins to produce the hydrocarbon fluids, olefins being polymerized or oligomerized, the intermediate product being then dearomatized by catalytic hydrogenation under severe conditions, and fractionation processes mentioned above. In one or more embodiments, the starting materials may include propene, butene or combinations thereof, for example.

In one or more embodiments, the hydrocarbon fluids are generally components selected from $C_9$-$C_{18}$ or narrower distillation cuts. Specific, non-limiting, examples of distillation cuts characterizing hydrocarbon fluids that may be blended to form the formulated propellant include SPIRDANE® (e.g., D-40 having a density of about 0.790 g/mL, a boiling range of 356° F.-419° F. (180-215° C.), flash point of 107.6° F. (42° C.) and D-60 having a density of about 0.770 g/mL, a boiling range of 311° F.-392° F. (155-200° C.), flash point of 145° F. (62° C.)), KETRUL® (e.g., D-70 having a density of about 0.817 g/mL, a boiling range of 381° F.-462° F. (193-238° C.), flash point of 160° F. (71° C.) and D-80 having a density of about 0.817 g/mL, a boiling range of 397° F.-465° F. (202-240° C.), flash point of 170.6° F. (77° C.)), HYDROSEAL® (e.g., G 232 H) and ISANE IP® fluids, commercially available from TOTAL FLUIDES, S.A., ISOPAR™ fluids, commercially available from ExxonMobil Chemical Corp. and IP2835, commercially available from Idemitsu Corp.

In one or more embodiments, the formulated propellant is formulated to exhibit a distillation curve having a front end within the fuel evaporated limits designated in Table 1 and an endpoint at or below the temperature of the endpoint specified in Table 1. For example, a plurality of hydrocarbon fluids may be selected from those available to produce a formulated propellant (end product) meeting the RP-1 specs. However, such formulated propellant may be formulated from a broad spectrum of hydrocarbon fluids that in and of themselves do not meet the RP-1 specification. Further, known jet fuel formulations may be incorporated with the hydrocarbon fluid. By utilizing such combinations, a broader tailored property distribution is achievable. For example, a specific, non-limiting formulated propellant may be formed of a first hydrocarbon fluid having a high end point while a second hydrocarbon fluid may have a low end point.

The formulated propellants overcome problems of RP1 availability/performance by blending existing hydrocarbon fluids to produce a propellant at least equal in properties and cost, if not superior to, RP-1. Further, such formulated propellants are capable of tailoring the properties (such as density, hydrogen content, and heat of combustion) of the propellants to a given propulsion system while exhibiting the ability to maintain, a higher level of specific impulse (Isp) than that available with conventional RP-1.

Specific impulse of a rocket propellant (Isp) is a parameter that relates the thrust generated to the mass flow rate of propellant into the combustion chamber. The ratio is proportional to the square root of the chamber temperature and inversely proportional to the square root of the chamber content molecular weight. Thus, specific impulse increases with increasing chamber temperature (which results in higher chamber pressures) and decreasing molecular weight of combustion products (which achieve higher exhaust velocities than heavier products). Specific impulse is essentially a momentum term. Anything done to increase the mass of fuel burned in a given amount of time or the velocity of the exhaust gases will have a beneficial effect. Higher specific impulses are desirable since greater thrusts are generated for a given weight of fuel combusted. The result is that a greater payload can be lifted into orbit or a higher orbit can be achieved than would otherwise be possible.

In one or more embodiments, the formulated propellants include two or more hydrocarbon fluids. For example, in one embodiment, the formulated propellant includes two hydrocarbon fluids. In another embodiment, the formulated propellant includes three hydrocarbon fluids. In yet another embodiment, the formulated propellant includes four hydrocarbon fluids. Individual hydrocarbon fluids are chosen for formulation into RP-1 type propellants depending on how they will contribute to the final properties of a rocket fuel blend. Utilized hydrocarbon fluids must fall within or overlap the distillation range for RP-1. Technically, this does not preclude the use of one individual hydrocarbon fluid as rocket fuel. However, the combination of two or more fluids results in greater flexibility in how closely one matches the distillation curve of RP-1. For example, when specifying two points within the specification for RP-1 distillation curves, the 10% and final point, one need not exactly match the RP-1 curve to be within the specification. For example, some hydrocarbon fluids that have a flash point below the RP-1 specification of 140° F. (60° C.) may be used in the formulation, but only in amounts that do not reduce the flash point of the final blend below the specification. Similarly, fluids with freeze points above the −60° F. (−51° C.) maximum specification may be included in the blend as long as the final freeze point is below that value. In practice, those materials that are characterized by a near absence of aromatics will have very low freeze points. The absence of aromatics leads to a higher net heat of combustion for the hydrocarbon fluids components used as blend stock. The combination of components should result in a product that exceeds the 18,500 BTU/pound specification. Isoparaffinic blend stocks help to raise the net heat of combustion when included in the blend, as their net heat of combustion is greater than aromatics or naphthenics that are characterized by the same carbon number. Accordingly, within the framework of the desired distillation curve, hydrocarbon fluids may be chosen to alter the density of the final blend. For example, naphthenic based fluids will tend to raise the final density while isoparaffinic fluids tend to reduce the density of the final product. The density of the final blend may be adjusted to be either within, above, or below the specified range for RP-1. Isoparaffinic stocks have low density and can be used to reduce this value. Materials that contain a significant amount of naphthenes and are at the high end of the distillation curve relative to RP-1, such as HYDROSEALS®, can be used to increase the density of the blended product.

Furthermore, density is an important parameter of the propellant as it determines the weight of the fuel that must be lifted by the vehicle. Accordingly, one or more embodiments utilize isoparaffin hydrocarbon fluids as at least one of the two or more hydrocarbon fluids. In one or more embodiments, the propellant may include a first hydrocarbon fluid having a density greater than 0.8 g/ml and a second hydrocarbon fluid having a density less than 0.8 g/ml, for example. The formulated propellants may have a weight that is about 5%, or 7% or 9% less than the weight of RP-1, for example.

The formulated propellants meet the RP-1 specifications regarding sulfur and may further include significantly reduced sulfur contents compared to conventional RP-1 propellants by the compositions of the present invention. For example, the propellants may include less than 30 ppm or less than 5 ppm sulfur, desirably less than 3 ppm sulfur, desirably less than 1 ppm sulfur.

The formulated propellants of the present invention meet the RP-1 specifications regarding aromatics and may further include significantly reduced aromatics contents compared to conventional RP-1 propellants by the compositions of the present invention. For example, the propellants may include less than 500 ppm, or less than 100 ppm aromatics, for example.

Due to the significant absence of olefins and aromatics from the formulated propellant, the formulated propellants exhibit improved thermal stability over RP-1. Engines utilized in the vehicles described herein may include cooling coils around an exhaust nozzle through which fuel from tanks flows prior to injection into a combustion chamber. The cooling coils periodically foul, in large part due to aromatics and/or olefins present in the propellant. Accordingly, the formulated propellants provide a fuel allowing reuse of booster stage rocket motors due to significantly reduced, if not eliminated, cooling coil fouling, for example.

Generally, RP-1 is a fuel utilized in the first-stage boosters of a variety of rockets. However, embodiments of the invention provide for the ability to formulate a first propellant for the booster stage and a second propellant for the upper stage or stages. Alternatively, embodiments of the invention provide for a propellant capable of use in both the booster and upper stage or stages.

It is further contemplated that the formulated propellant may contain various additives, such as dyes, antioxidants, metal deactivators, and combinations thereof, for example.

EXAMPLES

A sample of RP-1 and samples of various formulated propellants were analyzed by D-86, density, aniline point, cloud point, sulfur content, and aromatics content by FIA. The distillation curve and density were used to calculate hydrogen content by ASTM D-3343. The distillation curve, density, aniline point, sulfur content, and aromatics content were used to calculate the net heat of combustion by ASTM D-4529. As a basis for comparison, a sample of RP-1 was obtained and analyzed, with results illustrated in the data below. The density was measured at 15° C., as required by ASTM D-4529, which is an estimation of the net heat of combustion. Subsequent density measurements made on formulated propellants were done on the same basis. The tatter was used to calculate the net heat of combustion.

For the RP-1, sulfur content was well below the 30 ppm maximum. Cloud point was measured instead of freeze point. The hydrogen content was calculated using the empirical formulas in ASTM D-3343, which utilizes the density, distillation curve, and aromatics content. The value was 14.27%, surpassing the specification of 13.8% (wt). Further, there was a small amount of aromatics and olefins present, 1.22 and 1.10% (vol), respectively, which slightly reduce the hydrogen content. The theoretical maximum hydrogen content for a $C_{12}$-$C_{18}$ kerosene cut is between 14.9 and 15.3%. As a highly hydrotreated kerosene, the RP-1 would also be characterized by the presence of naphthenic rings. Its hydrogen content of 14.3% was consistent with a single naphthenic ring per molecule. The RP-1 distillation curve is shown in FIG. 1. The lines were inserted to show the distillation curve specifications. The 10% point must be reached between 365° F. (185° C.) and 410° F. (210° C.) and the end point must be below 525° F. (273° C.). As stated earlier, RP-1 is a narrow cut consisting of carbon number compounds ranging from $C_{12}$ to $C_{18}$. The gradual increase in temperature with percent distilled is indicative of a complex mixture of multiple carbon number compounds.

Figure 2:
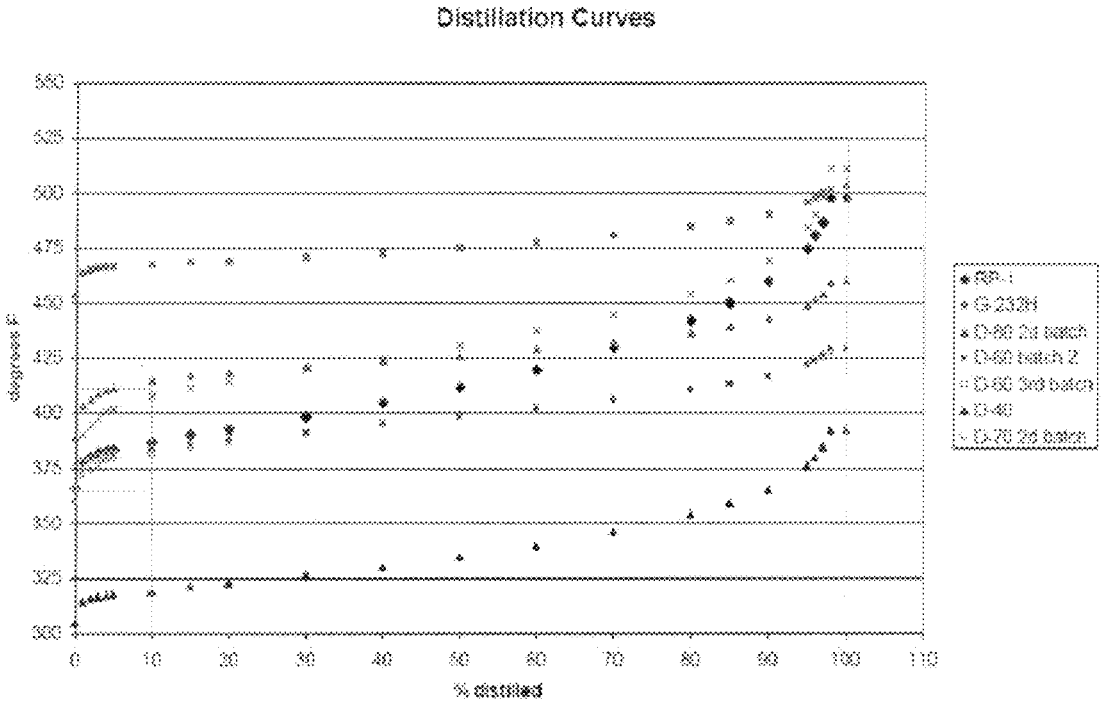
FIG. 2 illustrates distillation curves for formulated propellants.

The materials analyzed for use in the formulated propellants were SPIRDANE® D-40, SPIRDANE® D-60, KETRUL® D-70, KETRUL® D-80, HYDROSEAL® G 232 H, ISANE IP®175, and ISANE IP®185. The distillation curves for these components are shown in FIG. 2. Data is shown relative to the distillation curve for RP-1. None of the individual components was a close enough match to the RP-1 to be used "as is." The components were either higher boiling, as was the G 232H, lower boiling, like the D-60, or characterized by a narrower boiling range, like the D-80. However, this combination of attributes for the blend components affords the greatest flexibility in blending as the front, middle, and back end of the distillation curve for the propellant can be tailored to match the RP-1. Alternatively, various characteristics of the propellant relating to the distillation curve or other properties can be optimized through the appropriate selection of components for blending.

The density measurements for all components excluding the ISANE IP® materials were close to that of the RP-1. ISANE IP® materials were characterized by a lower density than that of RP-1. The net heats of combustion and hydrogen content for those components, including ISANE IP® materials, were comparable to the RP-1 also. These results suggested that combinations of the components would result in nearly the same values and properties as those of RP-1.

Once component data was compiled, formulated propellants were made. A number of prototype blends were made to gauge how the components affected each other in combination. Three prototypes were made and designated proto-6, proto-7, and proto-8. Proto-6 was designed to match the RP-1. Proto-7 and proto-8 were designed to be lower boiling and higher boiling than RP-1, on average, respectively. The latter two were made to determine what range of density and other properties would be achievable with the current blend components, such as SPIRDANE®, KETRUL®, and HYDROSEAL® based materials if the limits of the distillation curve were pushed. Blend formulations for the prototypes are shown in Table 3.

TABLE 3

| | Blend Formulation | | | |
|---|---|---|---|---|
| | D-60 (vol %) | D-70 (vol %) | D-80 (vol %) | G232H (vol %) |
| Proto-6 | 70 | 5 | 0 | 25 |
| Proto-7 | 90 | 5 | 0 | 5 |
| Proto-8 | 45 | 0 | 10 | 45 |

Figure 3:
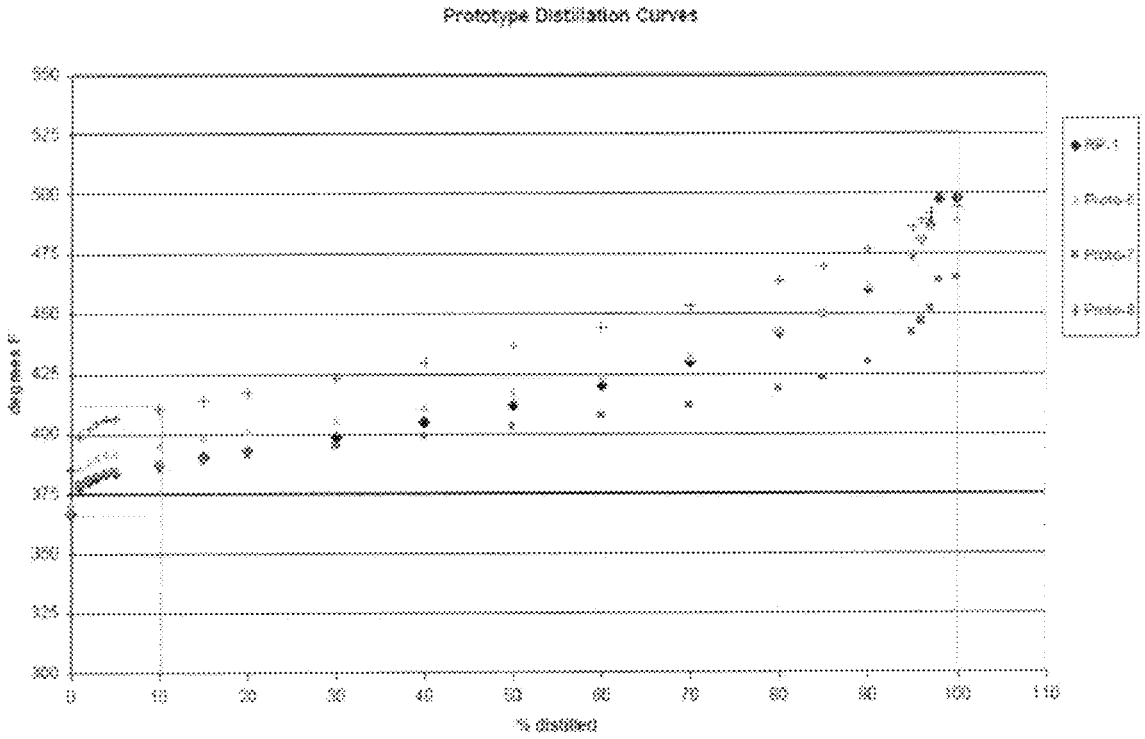
FIG. 3 illustrates distillation curve data of formulated propellants.

The distillation curve data is shown in FIG. 3. With specifications only at the 10% and the endpoint, there is wide latitude in the distillation curve that will meet the RP-1 specification. All three prototypes met this specification. Proto-8, designed to be high boiling on average, had a 10% point at 410° F., matching the limit of the specification. All three had end points below the 525° F. (273° C.) maximum. Proto-7 was significantly below it at 465° F. (240° C.), by design.

One can see the high concentration of the light D-60 component reflected in the position of the proto-7 distillation curve below all others. Similarly, the high concentration of the heavy component G232H raised the proto-8 distillation curve above all the others.

Figure 4:
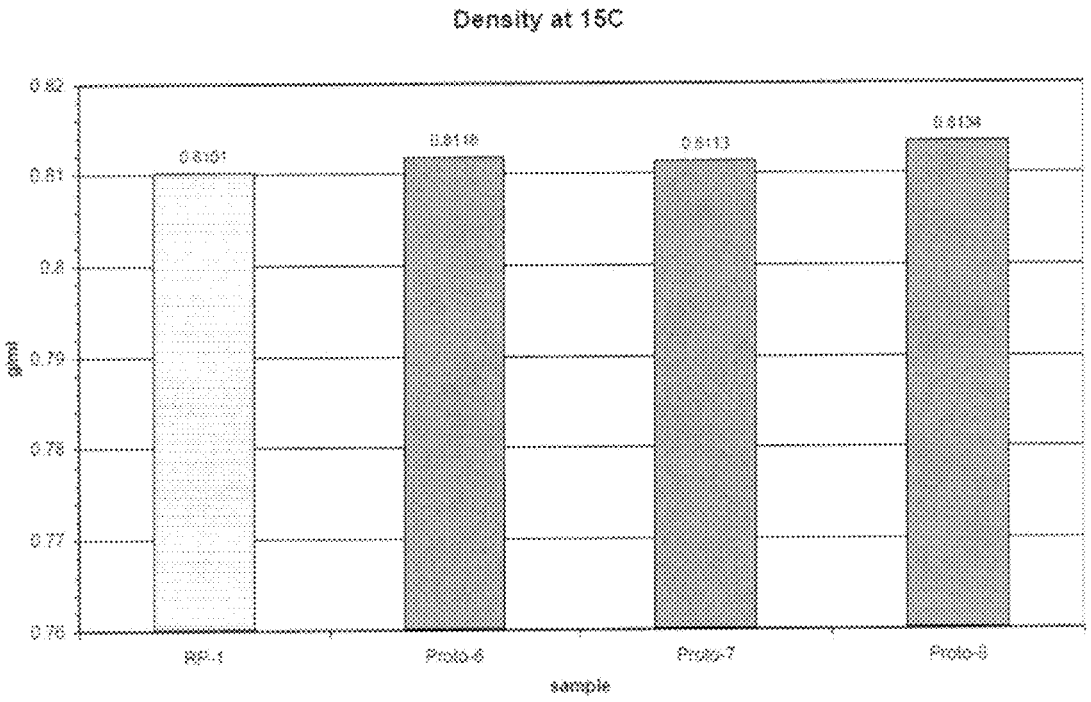
FIG. 4 illustrates density data for formulated propellants.

Cloud point data for all formulations was below the freeze specification of −60° F. (−51° C.) indicating that all have an acceptable freeze point. The sulfur content of the RP-1 was measured at 1 ppm by wavelength dispersive x-ray fluorescence, as noted earlier. Prototype formulations were at the limit of detection for that method with measurements at 0.5-0.6 ppm. These values are getting very close to the 0.1 ppm max limit for an RP-2 formulation. The density measurements were very close to that of the RP-1, albeit slightly higher, but still within the specification. This was consistent with the density of the blend stocks that were slightly above that of the RP-1 also. The density measurements are compared in FIG. 4.

ISANE IP®175 and 185 are characterized by densities significantly lower than RP-1, but have flash points that are at or above that of the specification. The density of each of these was below 0.77 g/ml, a significant reduction relative to other blend components and the RP-1. Additionally, the hydrogen content was measured between 15.1 and 15.2. This is in agreement with the theoretical value for a fully saturated sample with no naphthenic rings in the $C_{12}$ to $C_{18}$ range and as reflected by typical values reported on the certificate of analysis for these materials.

Figure 5:
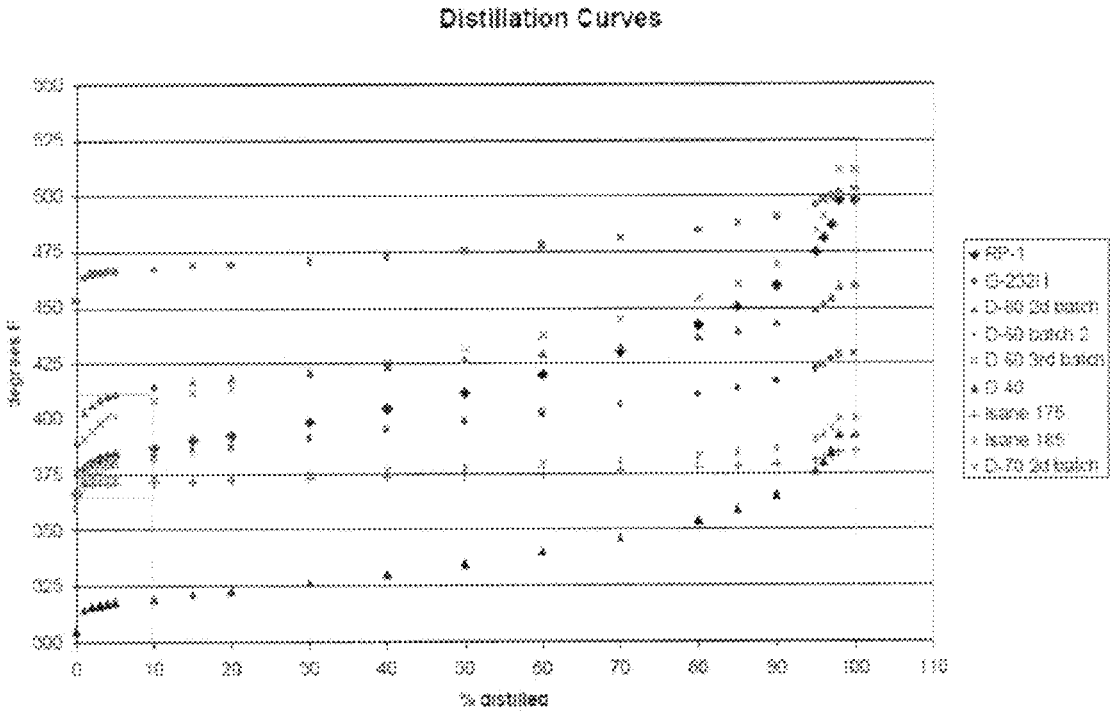
FIG. 5 illustrates distillation curve data of formulated propellants.

The distillation curve data is shown in FIG. 5 in comparison with the other components. The new materials are very narrow cuts with end points below 400° F. (204° C.). This necessitates the use of a middle and heavy cut in order to create an RP formulation. Additionally, the front end of the distillation curve was very clean indicating that few very light, low flash point compounds were present making these ideal blend components for the light portion of the formulation. The prototype blends formulated with the new components were designated proto-9 through 12. The composition of these blends is shown in Table 4.

TABLE 4

| Blend Formulation | D-60 (vol %) | D-70 (vol %) | D-80 (vol %) | G232H (vol %) | ISANE IP 175 (vol %) | ISANE IP 185 (vol %) |
|---|---|---|---|---|---|---|
| Proto-6 | 70 | 5 | 0 | 25 | 0 | 0 |
| Proto-7 | 90 | 5 | 0 | 5 | 0 | 0 |
| Proto-8 | 45 | 0 | 10 | 45 | 0 | 0 |
| Proto-9 | 0 | 10 | 0 | 30 | 0 | 60 |
| Proto-10 | 0 | 0 | 15 | 20 | 0 | 65 |

TABLE 4-continued

| Blend Formulation | D-60 (vol %) | D-70 (vol %) | D-80 (vol %) | G232H (vol %) | ISANE IP 175 (vol %) | ISANE IP 185 (vol %) |
|---|---|---|---|---|---|---|
| Proto-11 | 0 | 12.5 | 0 | 12.5 | 75 | 0 |
| Proto-12 | 0 | 15 | 0 | 20 | 0 | 65 |

Figure 6:
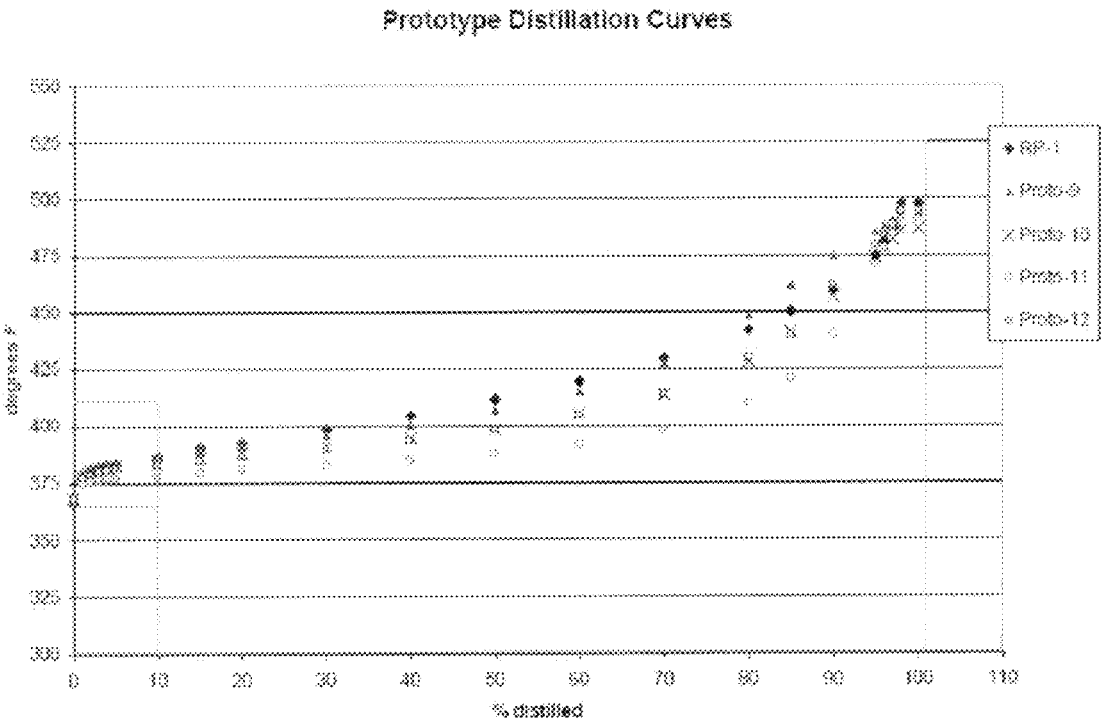
FIG. 6 illustrates distillation curves of formulated propellants.

The distillation curves corresponding to the new formulations are shown in FIG. 6. Proto-9 matched the RP-1 distillation curve closely, as it was designed to do. Proto-11 was designed to be a low density propellant, as shown by the rather high concentration of ISANE IP®175 in its formulation. Proto-10 and Proto-12 were formulated to contain a greater proportion of middle boiling compounds and examine the difference between the contributions of D-70 versus D-80 to the distillation curve. As shown, the difference was minimal for the quantities used.

Figure 7:
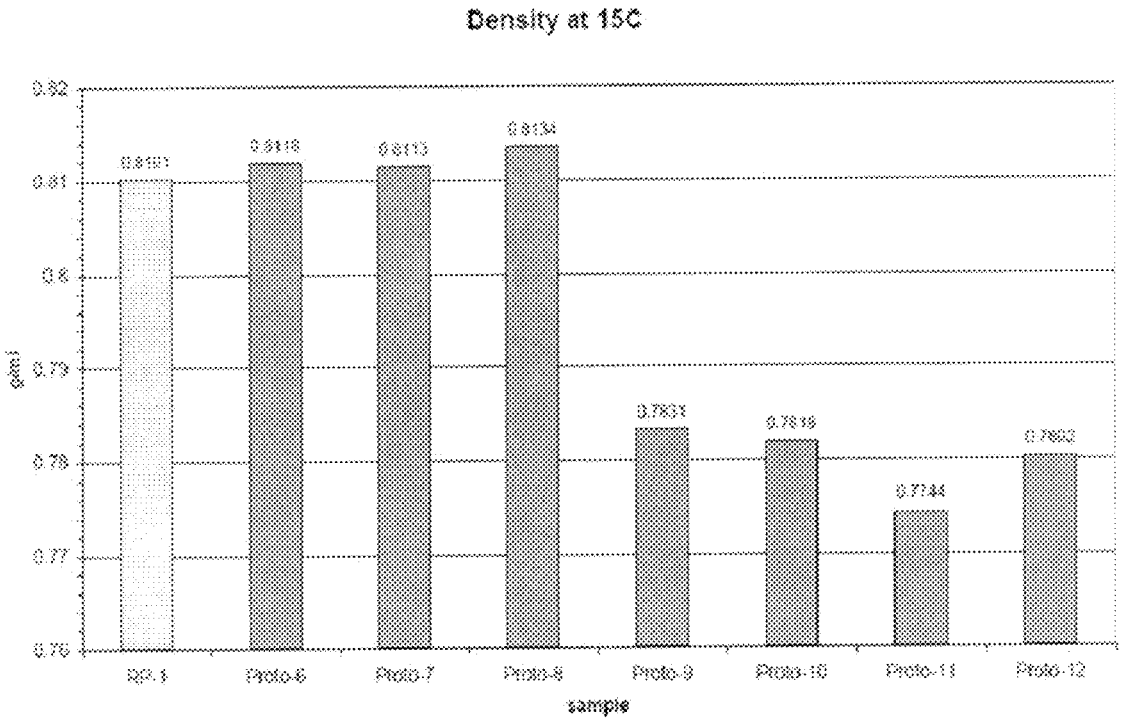
FIG. 7 illustrates density data for formulated propellants.
Figure 8:
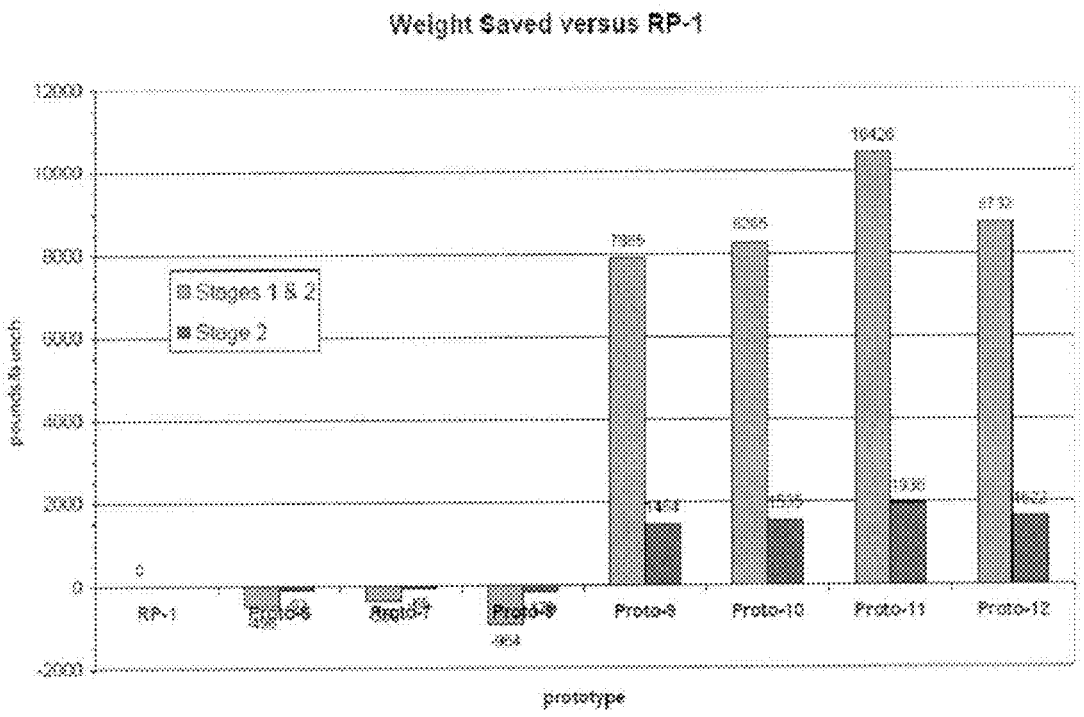
FIG. 8 illustrates weight savings of formulated propellants.

The immediate effect of the presence of replacing the lower boiling components with isoparaffins can be seen on the density measurement in FIG. 7. The step change in density is obvious. The low-density blend proto-11 was measured at 0.7744 g/ml. Given a hypothetical two stage vehicle with 28,500 gallons of fuel in the booster stage and 6,500 gallons in the second stage, the weight saved through use of the low-density prototypes is shown in FIG. 8. The upper stage weight savings for proto-9, the distillation curve copy of RP-1, is nearly 7% of the orbital payload. This savings is about 9% for the low-density proto-11. This is a huge increase in payload.

Figure 9:
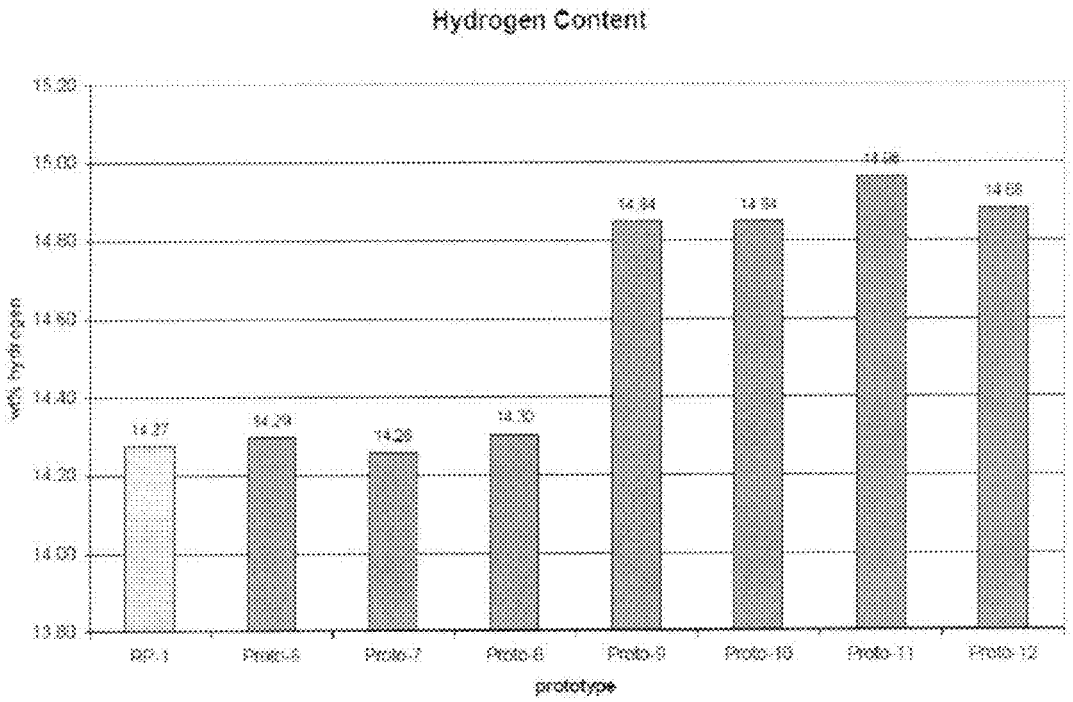
FIG. 9 illustrates hydrogen content for formulated propellants and FIG. 10 illustrates the Net Heat of Combustion.
Figure 10:
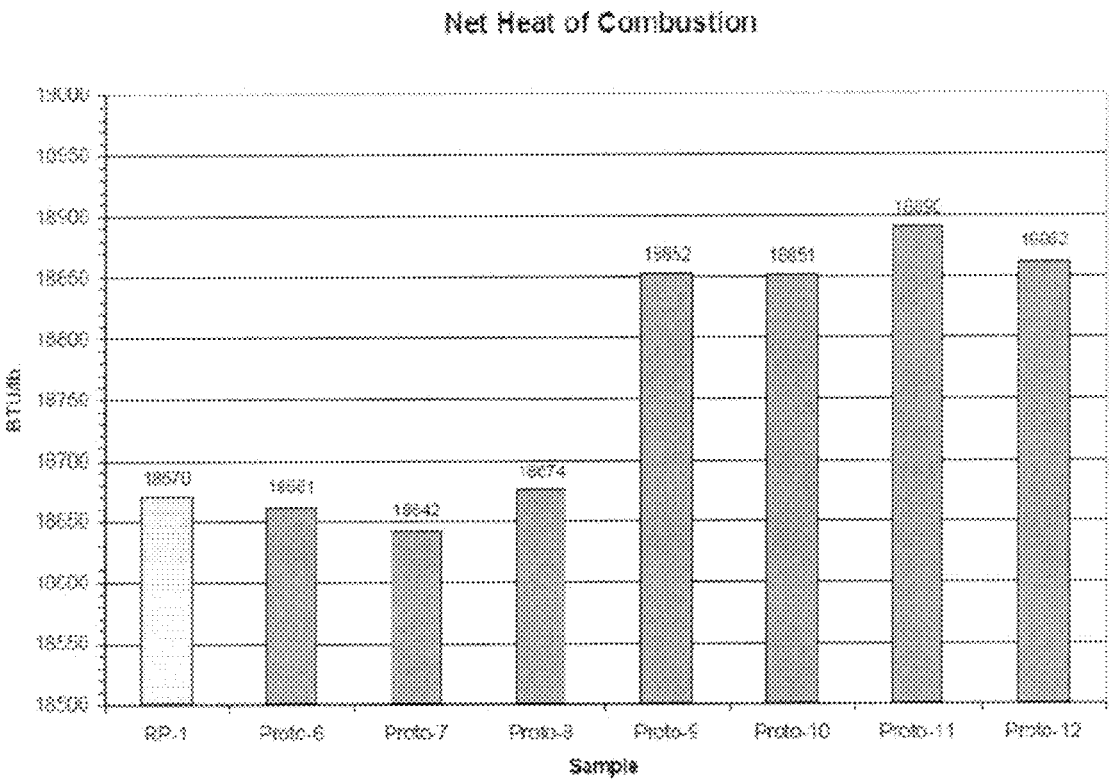

The hydrogen content for the prototypes is shown in FIG. 9. Replacing some of the compounds that are naphthenic in nature with the fully saturated isoparaffins resulted in a net increase in hydrogen content to nearly 14.9 for the RP-1 copy proto-9 and to 15 for the low-density formulation, proto-11. This was a significant increase relative to the RP-1 sample.

While the foregoing is directed to embodiments of the present invention, other and further embodiments of the invention may be devised without departing from the basic scope thereof and the scope thereof is determined by the claims that follow.

What is claimed is:

1. A formulated propellant comprising a hydrocarbon fluid, wherein the formulated propellant exhibits a distillation curve 10% point at a temperature between 365° F. (185° C.) and 410° F. (210° C.) and an end point at or below 525° F. (273° C.), and the formulated propellant contains more than 60 vol. % of isoparaffins.

2. The propellant of claim 1, wherein the propellant is formulated for vehicles selected from launch vehicles, rockets, and hypersonic space planes.

3. The propellant of claim 1, comprising less than 5 vol. % aromatics.

4. The propellant of claim 1, comprising less than 100 ppm aromatics.

5. The propellant of claim 1, comprising less than 30 ppm sulfur.

6. The propellant of claim 1, comprising less than 3 ppm sulfur.

7. The propellant of claim 1, comprising at least two hydrocarbon fluids.

8. The propellant of claim 1, comprising at least three hydrocarbon fluids.

9. The propellant of claim 7, wherein the at least two hydrocarbon fluids comprise a first fluid exhibiting a density greater than 0.8 g/ml and a second fluid exhibiting a density less than 0.8 g/ml.

10. The propellant of claim 1, wherein the formulated propellant meets RP-1 specifications.

11. The propellant of claim 7, wherein at least one of the hydrocarbon fluids is derived from petroleum refining cuts selected from gas oil, kerosene, straight run diesel, ultralow sulfur diesel, coker diesel, light cycle oil, after deep desulfuration and dearomatization or hydrodewaxing cuts, gas to liquid cuts or biomass conversion cuts, or polymerization of propene, butene or combinations thereof.

12. A method of formulating a formulated propellant comprising:

providing a hydrocarbon fluid and forumulating the hydrocarbon fluid to form the formulated propellant, and wherein the formulated propellant exhibits a distillation curve 10% point at a temperature between 365° F. (185° C.) and 410° F. (210° C.) and an end point at or below 525° F. (273° C.), and the formulated propellant contains more than 60 vol. % of isoparaffins.

13. The method of claim 12, wherein at least two hydrocarbon fluids are blended to form the formulated propellant.

14. The method of claim 12, wherein at least three hydrocarbon fluids are blended to form the formulated propellant.

15. The method of claim 12, wherein the formulated propellant meets RP-1 specifications.

16. The method of claim 13, wherein the at least two hydrocarbon fluids comprise a first fluid exhibiting a density greater than 0.8 g/ml and a second fluid exhibiting a density less than 0.8 g/ml.

17. A formulated propellant comprising a refined product from at least two separate starting materials, wherein the formulated propellant exhibits a distillation curve 10% point at a temperature between 365° F. (185° C.) and 410° F. (210° C.) and an end point at or below 525° F. (273° C.), and the formulated propellant contains more than 60 vol. % of isoparaffins.

18. The propellant of claim 17, wherein at least one of the starting materials is selected from gas oil, kerosene, straight run diesel, ultralow sulfur diesel, coker diesel, light cycle oil, hydrodewaxed gasoil or kerosene cuts, ethylene, propene, butene or combinations thereof.

19. The propellant of claim 17, wherein the at least two hydrocarbon fluids comprise a first fluid exhibiting a density greater than 0.8 g/ml and a second fluid exhibiting a density less than 0.8 g/ml.

20. A method of forming a formulated propellant comprising blending two or more hydrocarbon fluids to form a formulated propellant meeting RP-1 specifications, wherein the formulated propellant contains more than 60 vol. % of isoparaffins.

21. The formulated propellant of claim 1, comprising from more than 60 vol. % to 75 vol. % of isoparaffins.

22. The formulated propellant of claim 1, comprising from 10 to 15 vol. % of kerosene.

23. The formulated propellant of claim 1, comprising from 12.5 to 30 vol. % of gas oil.

24. The formulated propellant of claim 1, exhibiting a density less than 0.8 g/ml.

25. The formulated propellant of claim 1, which is substantially devoid of naphthenes.

* * * * *